US007117684B2

(12) United States Patent
Scudder et al.

(10) Patent No.: US 7,117,684 B2
(45) Date of Patent: Oct. 10, 2006

(54) CONTAINER WITH INTEGRAL MODULE FOR HEATING OR COOLING THE CONTENTS

(75) Inventors: James A. Scudder, Poway, CA (US); David C. Boucher, San Diego, CA (US); Peter J. Kapitzke, Poway, CA (US); Kenneth M. Sanderman, Lakeside, CA (US)

(73) Assignee: Ontech Delaware Inc., San Diego, CA (US)

( * ) Notice: Subject to any disclaimer, the term of this patent is extended or adjusted under 35 U.S.C. 154(b) by 0 days.

(21) Appl. No.: 10/800,987

(22) Filed: Mar. 15, 2004

(65) Prior Publication Data

US 2005/0198969 A1 Sep. 15, 2005

(51) Int. Cl.
*F25D 5/00* (2006.01)
*F24J 1/00* (2006.01)
*F24J 3/00* (2006.01)

(52) U.S. Cl. ..... 62/4; 62/60; 126/263.09

(58) Field of Classification Search ..... 62/4, 62/60; 126/263.01, 263.03, 263.08, 263.09
See application file for complete search history.

(56) References Cited

U.S. PATENT DOCUMENTS 2,288,895 A 7/1942 Fink
2,327,447 A 8/1943 O'Brien
2,746,265 A 5/1956 Mills
2,850,006 A 9/1958 Karpalo
2,900,808 A 8/1959 Wang
2,926,508 A 3/1960 Moon
3,213,932 A 10/1965 Gottfurcht
3,369,369 A 2/1968 Weiss
3,550,578 A * 12/1970 Fearon et al. ..... 156/296
3,815,867 A 6/1974 Rein et al.
3,842,617 A 10/1974 Chase et al.
3,863,832 A 2/1975 Gordon et al.
3,874,557 A 4/1975 Porter (Continued)

FOREIGN PATENT DOCUMENTS

CH 356576 8/1961

(Continued)

OTHER PUBLICATIONS

Toppan, KK & Haros catalogue page; Annex 1, date unknown.

*Primary Examiner*—William C. Doerrler
(74) *Attorney, Agent, or Firm*—Vista IP Law Group LLP

(57) ABSTRACT

A container comprises a container body for containing contents to be heated or cooled, a thermic module at one end of the body, and a closure at the other end of the body. Within the thermic module, an internal exothermic (or, alternatively, endothermic) chemical reaction is initiated to heat its contents when a user actuates the thermic module. The thermic module includes a heat exchanger portion extending proximally into the container and a thermic module cap distal to the heat exchanger portion. The heat exchanger portion has a pleated wall to improve the heat transfer to the contents of the container. The container includes a rotatable cover adhered to the container end over the closure with heat-sensitive adhesive that prevents a user from accessing the contents until a certain temperature is reached. The container further includes a full panel pull-off which covers and protects the actuator from being actuated until the pull-of lid is removed from the full panel pull-off. The thermic module may also include a filter disposed in interfering relation with the thermic module vents, including a portion between the inner and outer actuator buttons, to block egress of any particles of the solid reactant or the reaction product.

22 Claims, 14 Drawing Sheets

U.S. PATENT DOCUMENTS

| | | | | | |
|---|---|---|---|---|---|
| 3,970,068 | A | | 7/1976 | Sato | |
| 4,090,898 | A | | 5/1978 | Tuskos | |
| 4,158,084 | A | * | 6/1979 | Prentice | 429/112 |
| 4,501,259 | A | | 2/1985 | Apellaniz | |
| 4,511,610 | A | | 4/1985 | Yazaki et al. | |
| 4,556,445 | A | | 12/1985 | McCormick | |
| 4,640,264 | A | | 2/1987 | Yamaguchi et al. | |
| 4,741,324 | A | | 5/1988 | Ina et al. | |
| 4,758,003 | A | * | 7/1988 | Goldstein et al. | 277/314 |
| 4,762,113 | A | | 8/1988 | Hamasaki | |
| 4,773,389 | A | | 9/1988 | Hamasaki | |
| 4,784,113 | A | | 11/1988 | Nagai et al. | |
| 4,784,678 | A | | 11/1988 | Rudick et al. | |
| 4,793,323 | A | | 12/1988 | Guida et al. | |
| 4,802,343 | A | | 2/1989 | Rudick et al. | |
| 4,816,048 | A | | 3/1989 | Kimmelshue | |
| 4,819,612 | A | * | 4/1989 | Okamoto et al. | 126/263.01 |
| 4,895,135 | A | | 1/1990 | Hamasaki | |
| 5,088,870 | A | | 2/1992 | Fukuhara et al. | |
| 5,169,524 | A | | 12/1992 | Meiritz et al. | |
| 5,255,812 | A | | 10/1993 | Hsu | |
| 5,461,867 | A | * | 10/1995 | Scudder et al. | 62/4 |
| 5,465,707 | A | | 11/1995 | Fulcher et al. | |
| 5,483,949 | A | | 1/1996 | James | |
| 5,542,418 | A | | 8/1996 | James | |
| 5,555,741 | A | | 9/1996 | Oakley | |
| 5,626,022 | A | * | 5/1997 | Scudder et al. | 62/4 |
| 5,699,952 | A | | 12/1997 | Fix, Jr. | |
| 5,809,786 | A | * | 9/1998 | Scudder et al. | 62/4 |
| 5,833,127 | A | | 11/1998 | Powell et al. | |
| 5,941,078 | A | * | 8/1999 | Scudder et al. | 62/4 |
| 5,979,164 | A | * | 11/1999 | Scudder et al. | 62/4 |
| 6,248,257 | B1 | * | 6/2001 | Bell et al. | 252/70 |
| 6,266,879 | B1 | * | 7/2001 | Scudder et al. | 29/890.035 |
| 6,521,064 | B1 | * | 2/2003 | Tracy et al. | 149/42 |
| 6,644,383 | B1 | * | 11/2003 | Joseph et al. | 165/46 |

FOREIGN PATENT DOCUMENTS

| | | |
|---|---|---|
| EP | 255494 | 7/1987 |
| FR | 2659940 | 9/1991 |
| GB | 2131542 A | 12/1983 |
| JP | 62-078672 | 5/1987 |
| JP | 1-085283 | 6/1989 |
| JP | 1-085285 | 6/1989 |
| JP | 1-088882 | 6/1989 |
| JP | 1-161477 | 11/1989 |
| JP | 2-048029 | 4/1990 |
| JP | 2-098566 | 4/1990 |
| JP | 2-126528 | 10/1990 |
| JP | 2-130529 | 10/1990 |
| JP | 3-218715 | 9/1991 |
| JP | 4-025631 | 2/1992 |
| JP | 4-025632 | 2/1992 |
| JP | 4-117921 | 4/1992 |
| JP | 4-164412 | 6/1992 |
| JP | 4-108039 | 9/1992 |
| JP | 4-279117 | 10/1992 |
| WO | WO 93/17928 | 9/1993 |

* cited by examiner

FIG. 21

| Mineral components | Concentration (mg/L) |
|---|---|
| Mineral components | 83.0 |
| Chloride | 11.7 |
| Fluoride | ND |
| Nitrate | ND |
| Silica | 28.0 |
| Sulfate | 3.4 |
| Calcium | 16.6 |
| Magnesium | 3.3 |
| Potassium | 1.3 |
| Sodium | 11.7 |
| Total Dissolved Solids | 130 |
| Hardness | 55.0 |
| Heavy Metals | ND |
| Arsenic | ND |
| Trihalomethanes | ND |
| pH | 7.04 |
| Conductivity ( S | 250 |

(ND = Not Detectable)

FIG. 22

Property

| Additive | Molecular Formula | Molecular weight | Physical State | Appearance | Odor | pH | Vapor Density |
|---|---|---|---|---|---|---|---|
| Sodium Benzoate | C7H5C2Na | 144.02 | Crystalline powder | white | Characteristic odor | ~8 | 4.97 |
| Fructose | C6(H2O)6 | 180.16g | white crystals | white | odorless | | |
| Sucrose | C12H22O11 | 342.3g | Momoclinic sphenoidal crystals | | Characteristic caramel | solutions are neutral to litmus | |
| Citric Acid | C6H8O7 | 192.12g | white granules | white | odorless | 2.2 (0.1N sol) | |

| Additive | Evaporation rate | MP | Solubility | Specific Gravity/ Density | Chemical Stability | Incompatibilities with Other Materials | Hazardous Decomposition Products |
|---|---|---|---|---|---|---|---|
| Sodium Benzoate | negligible | >300C | Soluble in water | 1.44 | Stable under normal temps and pressures | Strong oxidizing agents | CO, CO2, NaO |
| Fructose | | 103-105C | Soluble in water | | Stable under normal temps and pressures. | Strong oxidizing agents | CO, CO2 |
| Sucrose | | 160-186C | 1gm/0.5ml water | 1.59 | Stable under normal temps and pressures | Oxidizers, suluric acid, and nitric acid | CO, CO2 |
| Citric Acid | | 153C | 60g/100ml at 20C | 1.665 | Stable under normal temps and pressures | Metal nitrates (explosive), alkali carbonates and bicarbonates, potassium tartrate. Will corrode copper, zinc, aluminum and their alloys | CO, CO2 |

CONTAINER WITH INTEGRAL MODULE FOR HEATING OR COOLING THE CONTENTS

BACKGROUND OF THE INVENTION

1. Field of the Invention

The present invention relates generally to containers that include an internal module that adds heat to or removes heat from a material, such as a food, beverage, medicine, or the like, in the surrounding container.

2. Description of the Related Art

Containers may have integral modules for warming materials in the container, such as sake, coffee, or soup. Examples of such self-heating containers are disclosed in U.S. Pat. Nos. 5,461,867; 5,626,022; and 6,351,953 issued to Scudder et al. All patents, patent applications and other publications referenced in this application are hereby incorporated by reference herein in their entirety. Such containers typically include an outer can or body, in which the food or beverage is sealed, and an inner can or thermic module that contains two chemical reactants that are stable when separated from one another but, when they mix in response to actuation of the thermic module by a user, produce an exothermic reaction or, alternatively, an endothermic reaction and thereby heat or cool the contents of the container.

As part of the manufacturing process of such containers which are used for holding food and beverages, the containers must go through a sterilization process called "retort." In general the retort process consists of subjecting the container and food contents to high temperatures and pressures. In a typical retort process, the container and contents are placed in a chamber for several minutes at 252 degrees Fahrenheit and two bars of pressure. Accordingly, the containers must be designed to withstand the retort process and still function properly.

The heating or cooling module (thermic module) is typically attached at one end of the cylindrical container body, and the elongated cylindrical reaction chamber portion of the module extends into the container body. This elongated portion functions as both a chamber in which to contain the reaction and a heat-exchanger for transferring heat between it and the surrounding contents of the container body. The thermic module has two chambers, each of which contains one of the chemical reactants, separated by a breakable barrier such as metal foil or a thin plastic film. Typically, one of the reactants is a liquid, and the other is in a solid powdered or granular form. Calcium oxide (commonly known as limestone) and water are examples of two reactants known to produce an exothermic reaction to heat the contents in such containers. Other combinations of reactants are known to produce endothermic reactions to cool the container contents. A cap containing the liquid reactant is disposed in the end of the thermic module attached to the container body. At one end of the cap is an actuator button that a user may press to initiate the heating or cooling. The barrier seals the other end of the cap. The cap has a pushrod or similar prong-like member that extends from the actuator button nearly to the barrier. Depressing the actuator button forces the prong into the barrier, puncturing it and thereby allowing the liquid reactant to flow into the solid reactant in the reaction chamber. The heat produced by the resulting exothermic reaction or absorbed by the resulting endothermic reaction is transferred between the reaction chamber of the thermic module and the contents of the container body by conduction. Exothermic reactions also typically generate a gas and/or steam, which is allowed to escape through vents in the end of the container. The user inverts the container and, when the contents have reached the desired temperature, consumes the contents. The second end of the container body has a seal or closure, such as a conventional beverage can pull-tab, that may be opened and through which the user may consume the heated or cooled contents.

A portion of the thermic module, such as the elongated cylindrical reaction chamber, may be unitarily formed with the outer can, as illustrated, for example, in U.S. Pat. No. 3,970,068, issued to Sato, and U.S. Pat. No. 5,088,870, issued to Fukuhara et al. The unitary container body is formed by providing a metal cylinder that is open at one end and closed at the other, and punching or deep-drawing a cavity in the closed end. A cap containing the liquid reactant is attached to the open end of the cavity. In other such containers, however, the elongated cylindrical reaction chamber may be separately formed and then attached to the container body by another manufacturing step. It would be desirable to provide an economical and reliable method for manufacturing this latter type of container.

The previously known elongated reaction chambers present several other design drawbacks. For one, the wall of the elongated reaction chamber separates the reaction chamber from the material contained in the container which is heated or cooled. This wall acts as an insulator which can slow the heating or cooling of the material by the thermic module. In addition, in response to the retort process, the chambers have suffered excessive deformation and cracking and have shown an inability to return to their expanded shape after being compressed during retort.

The retort process also has the potential to cause weakening or failure of the bond holding the breakable barrier separating the two chambers of the thermic module. The breakable barrier is typically heat sealed to a circular top edge of one chamber of the thermic module. During retort, the pressure of air expanding under the barrier tends to push the barrier upward into a dome shape which can cause the bond to weaken or detach.

Another problem associated with self-heating and self-cooling containers is that a person may attempt to consume the contents before the contents have been fully heated or cooled. That the person may be displeased by the resulting temperature of the beverage or other contents is not the only effect. A perhaps more serious effect is that a self-heating container may overheat and present a burn hazard if, after the user empties it of its contents, it continues to generate heat, because the contents act as a heat sink. It would be desirable to provide a self-heating container that prevents or inhibits a user from consuming the contents before the heating reaction has completed.

As disclosed in the above-referenced U.S. patents, the actuator button may be protected by a foil safety seal. An unbroken seal assures a person that the container has not been actuated and is thus ready for use. Also, the reactivity of typical chemicals such as calcium oxide may decrease if they absorb atmospheric moisture, such as could occur if the container were in storage or in transit for prolonged periods in a moist environment prior to use, and the seal inhibits exposure of the reactants to atmospheric moisture. To use the container, the user peels the foil seal off the container and discards it. The removal of the foil seal presents a disposal problem because the user may not be within a convenient distance of a trash receptacle. It would further be desirable to minimize disposal problems associated with self-heating and self-cooling containers.

The present invention is directed to improvements in self-heating containers which overcome these problems and deficiencies.

SUMMARY OF THE INVENTION

The present invention relates to a container having a container body, a thermic module at one end of the body, and a closure at the other end of the body. The body may have any suitable generally tubular shape, such as cylindrical or can-shaped or bottle-shaped. The food, beverage, medicine or other material to be heated or cooled is contained in a material cavity in the container body. The thermic module contains a chemical reactant that is segregated from another reactant in the container. When a user actuates the thermic module, the reactants mix and produce a reaction that, depending upon the reactants, either produces heat, i.e., an exothermic reaction, and thereby heats the container contents, or absorbs heat, i.e., an endothermic reaction, and thereby cools the container contents.

In accordance with one aspect of the present invention, a plastic thermic module body is spin-welded to a plastic container body by rotating one relative to and in contact with the other. The frictionally generated heat fuses or welds the contacting plastic surfaces together. The container body may have multiple layers, including an oxygen and flavor scalping barrier layer that inhibits oxidation and spoilage of the contents. Spin-welding the container body to the module body in this manner seals the portion of the inner layer that is exposed at the annular end of the container body between two plastic layers and thereby prevents air or moisture from seeping past the outer plastic layer and into the inner layer.

In accordance with still another aspect of the present invention, the thermic module body has a heat exchanger portion having a pleated wall. The pleated design is provided with relatively large radii at the peaks and valleys of the pleats. The heat exchanger portion also has a plurality of circumferential grooves which longitudinally separate the pleated portions. The large radii and grooves help prevent the thermic module from failing under the pressure and temperature of the retort process.

In accordance with another aspect of the present invention, the container includes a movable cover mounted over the closure. A suitable heat-sensitive adhesive between the cover and the container inhibits movement of the cover until the temperature has reached a certain threshold. The adhesive bond softens when the adhesive reaches approximately that temperature. In an exemplary embodiment of the invention, the cover is rotatable. The cover has an opening, and when the threshold temperature is reached, the user can rotate the cover until the opening is aligned with the closure. The user may then open the closure and consume the contents of the container.

In accordance with still another aspect of the invention, the thermic module includes a seal, such as a foil disc, between an inner actuator button and an outer actuator button. The inner actuator button may be included in a module cap that holds the solid reactant. The outer actuator button has one or more apertures and also has one or more prongs directed toward the seal. When the user presses the outer actuator button, the prong punctures the seal. This actuator structure eliminates the disposal problem associated with a removable foil seal. In addition, if for some reason the module cap were to become over-pressurized prior to use, the pressure would force the inner actuator button against the seal. The seal, in turn, presses against the prong and punctures it, thereby relieving the pressure through the apertures in the outer actuator button.

In another aspect of the present invention, as an alternative to the outer actuator button and tamper-evident foil disc, the container comprises a full panel pull-off attached to the bottom of the container. A full panel pull-off is a removable cover like those used on canned foods and is like a typical pop-tab closure (e.g. the closure on a soft-drink or soup metal can) except that the lid part that is removable covers substantially the entire opening of the container rather than just a small opening. The full panel pull-off completely covers the inner actuator button and may be made of aluminum such that the actuator button cannot be pushed until the full panel pull-off is removed. The full-panel pull-off provides a tamper-evident seal and also protects the actuator button from being inadvertently pushed. The full panel pull-off may also provide a pressure safety release valve. In the event that the breakable barrier is pushed without removing the full panel pull-off, pressure will build up inside the container because the vent holes in the thermic module vent only to the interior of the full panel pull-off. If the pressure reaches a certain level, the full panel pull-off will partially open thereby relieving the pressure.

In yet another aspect of the present invention, a vent hole is provided in the sidewall at the bottom of the container. Like the full panel pull-off, the vent hole is a safety feature which releases pressure from the inside of the thermic module in the event that the reaction is actuated without removing the full panel pull-off. The outside wall of the container body may be provided with a swirl or helical shaped groove which runs from the vent hole. Attaching the label on the surface of the container over the groove creates a conduit leading from the vent hole. In this way, steam that exits the container through the vent hole will travel in this conduit along the cooler outer surface of the container such that the steam will cool and condense.

The thermic module may also include a filter disposed in interfering relation with the vents between the inner and outer actuator buttons to block egress of any particles of the solid reactant or the reaction product, and also absorb water (gaseous and liquid) during the reaction. The filter may include a disc-shaped portion between the inner and outer actuator buttons and an annular portion between flanges coupled to the actuator buttons. The disc-shaped portion may be integrally formed with the annular portion prior to assembly of the container and separated from one another along an annular perforation line during a manufacturing step in which the filter portions are inserted into the thermic module.

In still another aspect of the present invention, the two reactants producing the thermal reaction are specially designed calcium oxide particles and water. The calcium oxide particles are sized and shaped to optimize the heating profile of the container. The particles also comprise additives to affect the reaction. In another aspect of the invention, the water is purified and selected additives are included in the water to modify the reaction with the calcium oxide particles to optimize the heating profile of the container. The ration of water to calcium oxide is also pre-determined to produce the desired heating profile.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 21 is a table of mineral components in water that should not be exceeded.

FIG.22 is a table of additives which may be added to the calcium oxide reactant.

DESCRIPTION OF PREFERRED EMBODIMENTS

Figure 3:
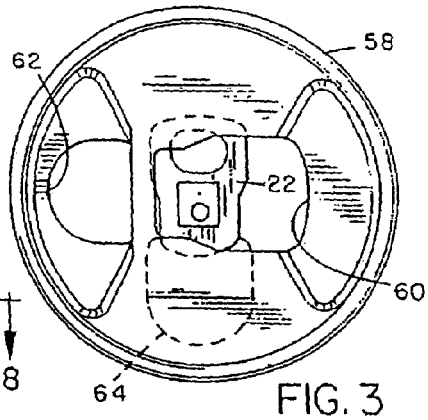
FIG. 3 is a top view of the container with the cap in the closed position.
Figure 4:
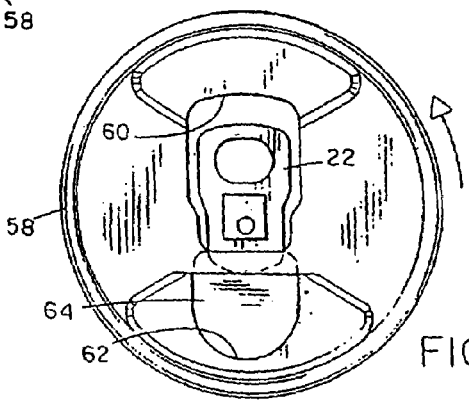
FIG. 4 is a view similar to FIG. 3, with the cap rotated to the opened position.
Figure 5:
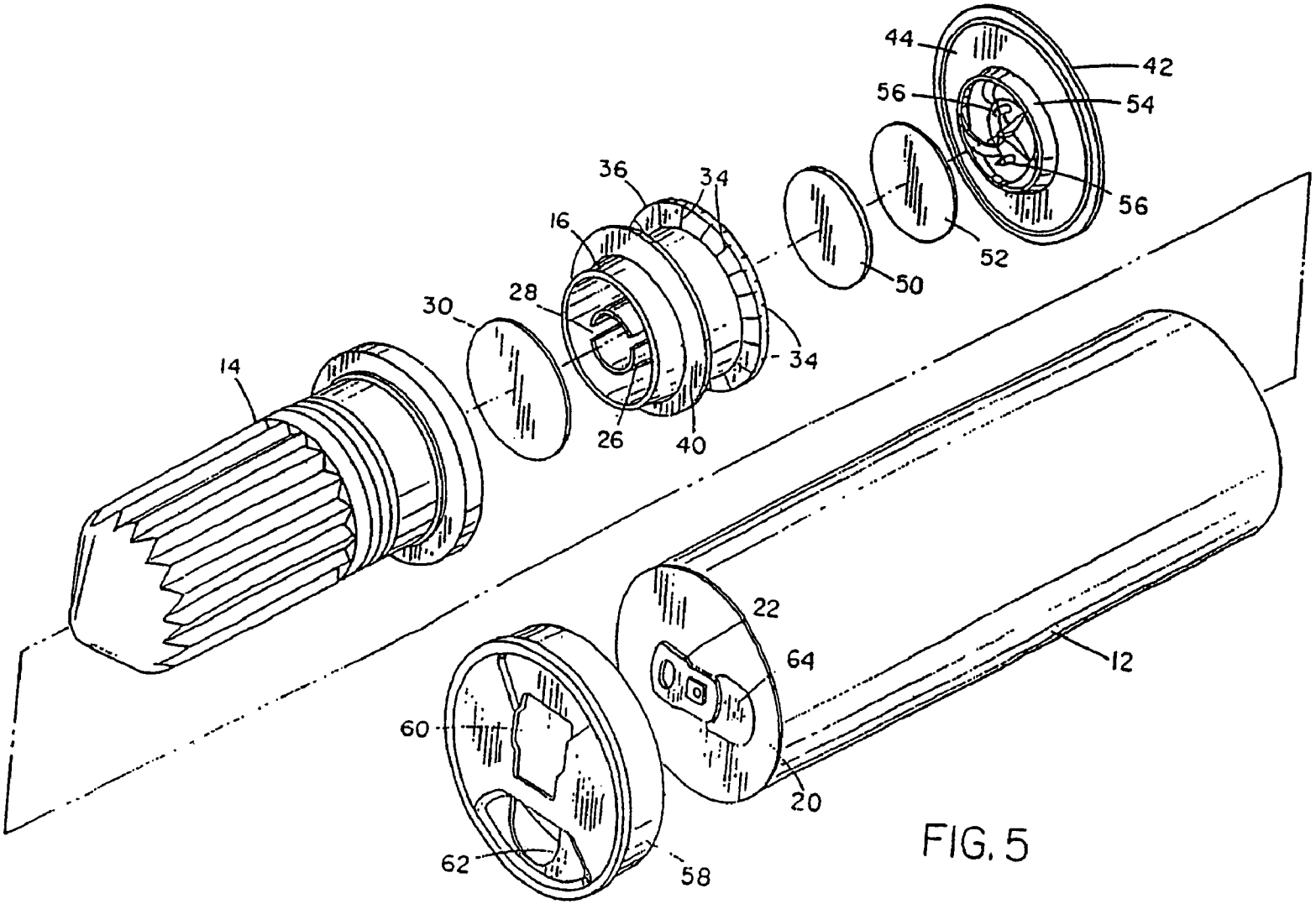
FIG. 5 is an exploded perspective view of the elements of the container.
Figure 6:
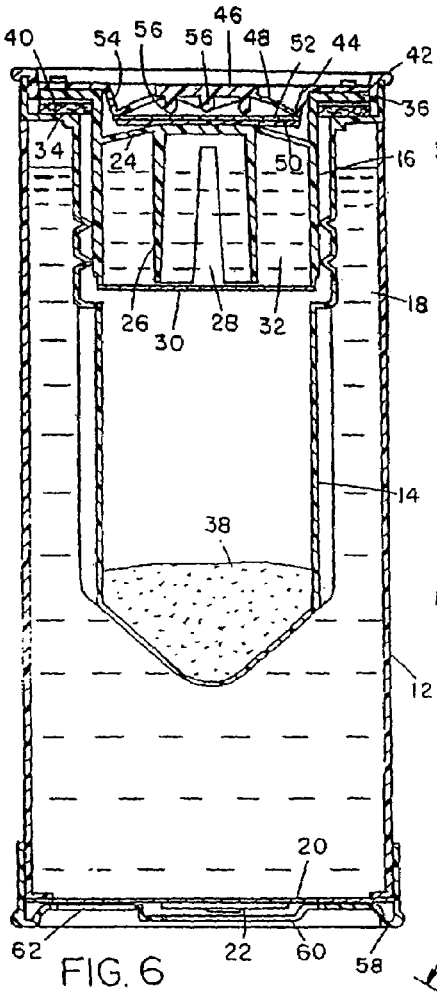
FIG. 6 is a sectional view taken on line 6—6 of FIG. 1.
Figure 7:
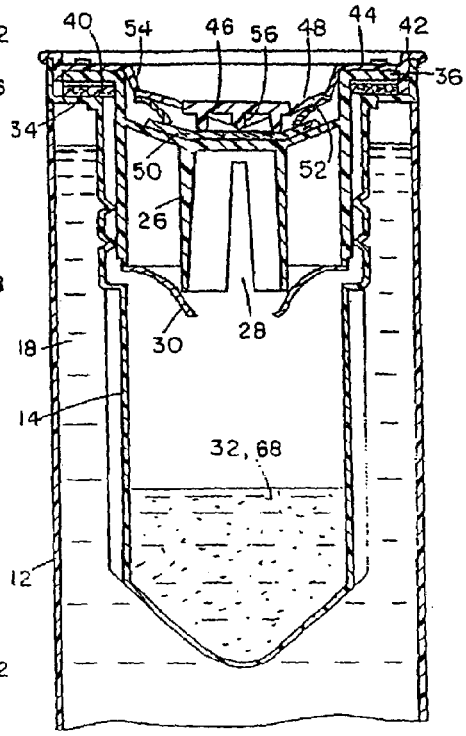
FIG. 7 is a similar sectional view showing the container after actuation.

As illustrated in FIGS. 1–8, a container 10 includes a container body 12, a thermic module body 14, and a thermic module cap 16. As best illustrated in FIGS. 5–7, module body 14 has an elongated heat-exchanger portion that extends into container body 16. The interior of this portion defines a reaction chamber in which the reaction occurs that heats (or, in alternative embodiments of the invention, cools) the beverage or other contents 18. The heat-exchanger portion has a corrugated or pleated wall to increase surface area and, as a result, heat transfer. Although in the illustrated embodiment the wall is corrugated or pleated, in other embodiments the wall may have other suitable geometries. Module cap 16 is press-fit in the open end of module body 14. An endcap 20 with a pop-tab closure 22 of the type commonly used in beverage cans is crimped over the other end of container body 12 in the manner of a conventional beverage can.

Module cap 16 is of unitary construction and is made of a semi-rigid plastic, such as high density polyethylene. Module cap 16 has a disc-shaped or dome-shaped inner actuator button 24 and a cylindrical prong 26 with an elongated notch 28. A breakable reactant barrier 30 made of metal foil is adhesively attached to the open end of module cap 16 to seal the water or other liquid reactant 32 inside.

Module cap 16 has multiple vent channels 34 distributed around its outside surface. When module cap 16 is fit in the open end of module body 14, each of vent channels 34 provides a channel through which gas can escape during the reaction. Vent channels 34 extend longitudinally along the outside surface of the body portion of module cap 16, change direction to extend radially along the lower surface of the flange portion 36 of module cap 16, change direction again to extend longitudinally along the outside cylindrical surface of flange portion 36, and change direction again to extend radially along the upper surface of flange portion 36. This long, narrow, zig-zag path of channels 34 inhibits escape of particles of the calcium oxide or other solid reactant 38 while allowing gas to vent.

A filter ring 40 is sandwiched between flange portion 36 and thermic module body 14. Filter ring 40 further prevents solid particles from escaping through vent channels 34 while allowing gases to vent unimpeded. Filter ring 40 may be made of any suitable filter material such as synthetic sponge, open-cell foamed rubber, or any woven or fibrous materials such as paper and cloth. A suitable material is commercially available from Filter Material Corporation of Wisconsin under the product number AC20.

Figure 1:
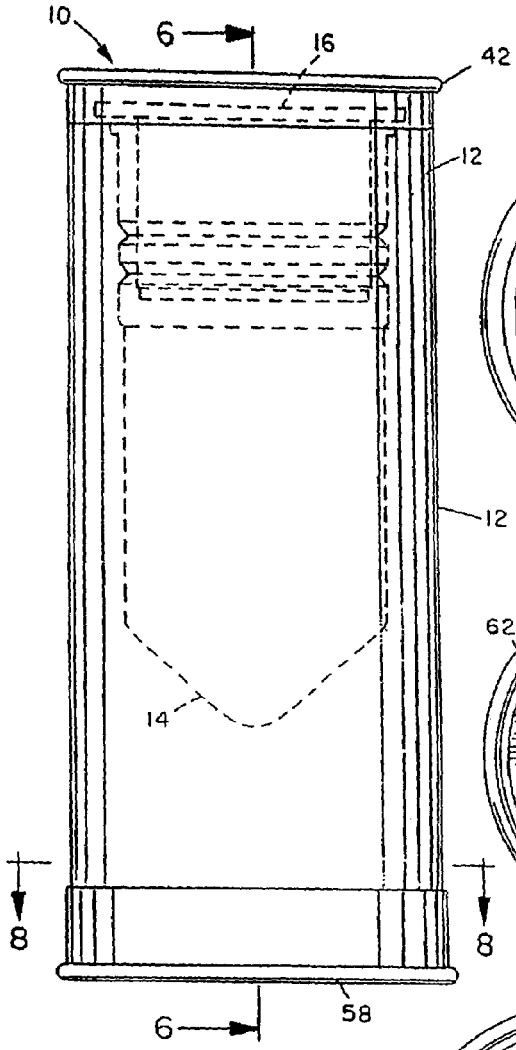
FIG. 1 is a side view of a container of the present invention.
Figure 2:
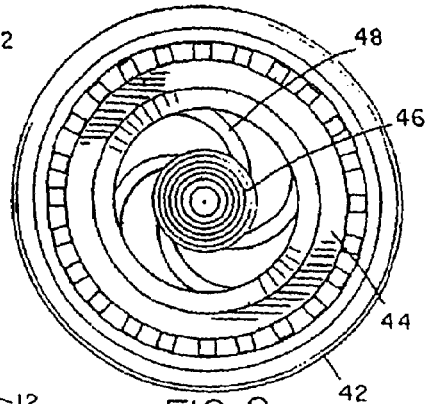
FIG. 2 is a bottom view of the container.

An outer actuator assembly 40 is attached to the end of container body 12 and, as best illustrated in FIG. 2, includes a ring portion 44 and an outer actuator button 46. The ring of squares shown around the outer periphery of ring portion 44 in FIG. 2 are surface features that facilitate spin-welding outer actuator assembly 42 to the end of container body 12 as described below. Outer actuator button 46 is supported on at least three but preferably four spline-shaped fingers 48, suspending it in a resiliently deflectable manner within the interior of ring portion 44. Outer actuator button 46, fingers 48 and ring portion 44 are preferably unitarily formed as a molded plastic part. The concentric rings shown within outer actuator button 46 in FIG. 2 are surface features that provide a frictional grip for user's finger when actuating the container as described below. A filter disc 50, preferably made of the same material as filter ring 40, is sandwiched between outer actuator assembly 42 and inner actuator button 24. Although filter ring 40 provides an adequate filter by itself, filter disc 50 may be included in certain embodiments of the invention to further enhance filtering. An advantage in manufacturing economy may be achieved in such embodiments by forming filter ring 40 and filter disc 50 as a unitary part with perforations between them, and handling them as a unitary part until they are separated during the manufacturing step in which they are assembled into container 10.

As illustrated in FIGS. 5–7, outer actuator assembly 42 further includes an breakable actuator barrier 52. Breakable actuator barrier 52 is preferably made of metal foil that is adhesively attached to the end of an annular cuff portion 54 projecting from the interior periphery of ring portion 44. Three pointed projections 56 extend from the underside of outer actuator button 46 toward actuator barrier 52. The star-shaped or x-shaped surface feature centered at the middle one of projections 56 reinforces outer actuator button 46 but is not otherwise significant to the invention.

Figure 8:
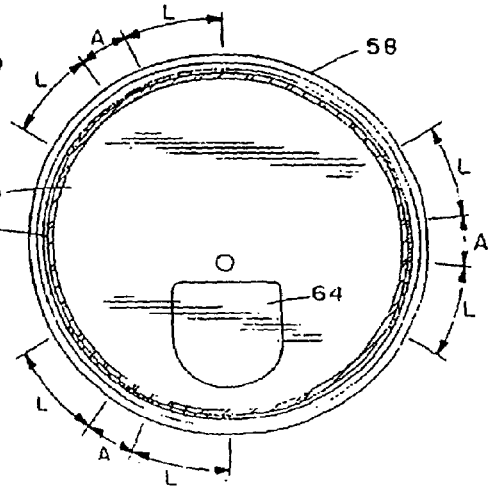
FIG. 8 is a sectional view taken on line 8–18 of FIG. 1.
Figure 9:
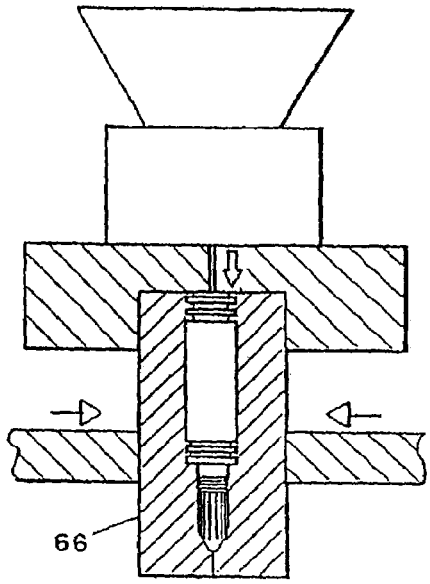
FIG. 9 illustrates the manufacturing step of blow-molding the plastic body elements of the container.

As illustrated in FIGS. 3–5, lid 58 is mounted over endcap 20 and the end of container body 12. Lid 58 has two apertures 60 and 62. As illustrated in FIG. 8, lid 58 is mounted to the end of container body 12 with patches or spots of heat-sensitive adhesive (labeled "A") having an adhesion strength that, generally speaking, decreases with an increase in temperature. Thus, the adhesive immobilizes lid 58 until container 10 is actuated and produces heat. A range of such heat-sensitive adhesives are commercially available with various specifications. One parameter that can typically be specified is the threshold temperature at which the adhesive loses (or, conversely, achieves) substantial adhesion strength. Suitable adhesives are manufactured by National Starch and Chemical of Illinois under the product numbers 34-2780 and 70-4467. Although its precise formulation is proprietary to the manufacturer, the manufacturer describes the adhesive as starch-based. Before a user actuates container 10, cap 58 is in the position shown in FIG. 3. In this position aperture 60 is not aligned with pop-tab closure 22 and thus prevents a user from opening closure 22. Also, in this position aperture 62 is not aligned with the sealed opening 64 through which beverage 18 can be consumed. When container 10 heats and the adhesive reaches the threshold temperature, it loses sufficient adhesion strength that a user can move cap 58. The user rotates cap 58 until it is in the position shown in FIG. 4, as indicated by the arrow. In this position aperture 60 is aligned with pop-tab closure 22, thereby allowing the user to open it. Also, in this position aperture 62 is aligned with the sealed opening through which the user can consume the beverage. As in a conventional soft drink can, opening pop-tab closure 22 breaks the seal and allows a user to drink beverage 18 through the resulting opening. The user's lips contact the relatively cool plastic of cap 58 rather than the potentially very hot metal of endcap 20.

Although exactitude in the threshold temperature is not necessary for the invention to work properly, it is preferable in a container for a beverage such as coffee or tea that the adhesive maintains substantial adhesion when its temperature is below about 100 degrees Fahrenheit (38 Celsius) and loses substantial adhesion when its temperature exceeds said this threshold. The preferred adhesive hoted above that is manufactured by National Starch and Chemical has this property. For purposes of this patent specification, the term "substantial adhesion" refers to the inability of a user to rotate lid 58 by exerting no more than the normal amount of torque that a person typically exerts when opening a jar or other screw-top food or beverage container without the assistance of tools. Although the adhesion strength of such adhesives continues to decrease to some extent with an increase in temperature over a fairly wide range, the adhesion strength decreases much more sharply at the threshold temperature than at other temperatures in the range.

To actuate container 10, the user depresses outer actuator button 46 by exerting a force upon it in the general direction of the longitudinal axis of container 10. As noted above, actuator button 46 is suspended by fingers 48, which resiliently deflect to allow button 46 to move in this axial direction. The force exerted upon outer actuator button 46 urges its projections 56 into actuator barrier 52, puncturing it. The force further urges outer actuator button 46 toward inner actuator button 24, which in turn is urged in the same axial direction. Inner actuator button 24 is flexible and responds to the force by popping or snapping inwardly toward reactant barrier 30.

In response to the inward flexure of inner actuator button 24, the distal end of prong 26 punctures reactant barrier 30. Water 32 flows through punctured reactant barrier 30 and mixes with solid reactant 38 in the reaction chamber, i.e., the interior of the elongated portion of thermic module body 14. Notch 28 in prong 26 facilitates the flow of water 18 into the reaction chamber. The resulting exothermic reaction produces heat, which is transferred to beverage 18 by conduction through the pleated wall of the heat-exchanger portion of thermic module body 14. As noted above, in other embodiments of the invention, other reactants may be selected that give rise to an endothermic reaction when mixed.

Gas or steam produced in the reaction escapes the reaction chamber through vent channels 34, but any solid particles are filtered out by filter ring 40 or filter disc 50. Note that the inherent saturation of filter ring 40 and filter disc 50 by the escaping steam may enhance this filtration. The gas or steam that passes through filter ring 40 or filter disc 50 passes through the punctured actuator barrier 52 and exits container 10 through the spaces between fingers 48.

The user can then invert container 10 and wait until the reaction heats beverage 18, which typically occurs within about five minutes in a container 10 having a capacity of 10 fluid ounces (296 ml) of water or comparable beverage such as coffee or tea. As described above, when beverage 18 is heated to the temperature at which it is to be consumed, the adhesive has loosened sufficiently to allow the user to rotate cap 58. Patches or spots of a suitable lubricant (labeled "L" in FIG. 8) are interspersed with the adhesive patches so that when cap 58 is rotated the lubricant smears and prevents the adhesive from re-adhering cap 58 as it begins to cool and also allows the user to more easily rotate cap 58. The lubricant is preferably food-grade or approved for incidental food contact by the appropriate governmental authority, such as the Food and Drug Administration in the United States. The user then opens pop-tab closure 22 as described above and consumes beverage 18.

The method of manufacturing container 10 may include the steps illustrated in FIGS. 9, 10 and 11A–C. The manufacturing method is an important aspect of the invention because it addresses several problems. Container body 12 and thermic module body 14 are preferably made of multiple layers, including an oxygen-barrier layer, to maintain the freshness and stability of beverage 18 or other contents. Such multiple-layer plastic container technology is familiar to persons of skill in the art to which the invention relates and is described in, for example, Blow Molding Handbook, edited by Donald Rosato and Dominick Rosato, Hanser Publishers. As known in the art, a multiple-head blow-molding machine such as that illustrated in FIG. 9 can be used to produce multiple-layer plastic containers. In accordance with the blow-molding method, the machine positions a suitable mold 66 beneath the blow-molding head (known as a W. Mueller head), extrudes the plastic resin layers simultaneously, and then injects air to conform the plastic to the contours of the mold cavity. The machine then cools the mold, opens it, removes the molded part, and repeats the process. A suitable blow-molding machine is commercially available from B&W of Berlin, Germany under the name/Model No. DE3000. Although this machine can work with two or more molds simultaneously, this aspect is not particularly relevant to the manufacturing method of the present invention.

Figure 10:
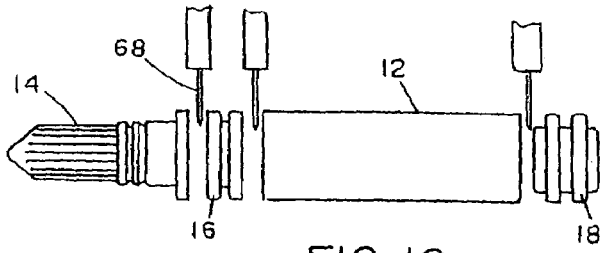
FIG. 10 illustrates the manufacturing step of separating the elements from one another following blow-molding.
Figure 11A:
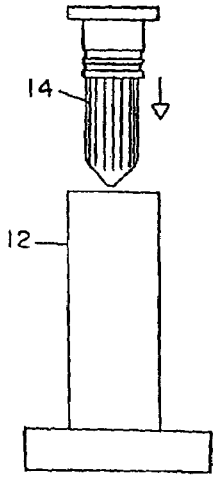
FIGS. 11A–C respectively illustrate the sequence of manufacturing steps that comprise spin-welding the container body to the module body.
Figure 11B:
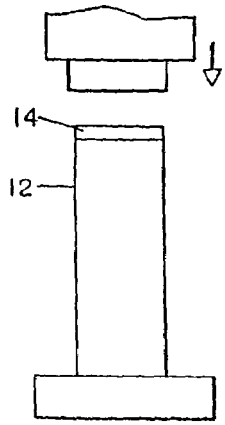
Figure 11C:
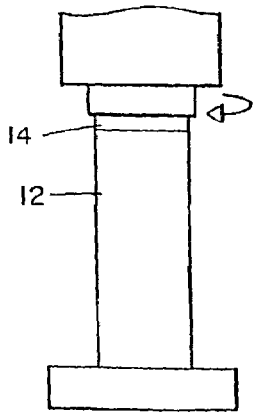

Important to manufacturing economy is that mold 66 is configured to produce one container body 12 and one thermic module body 14 as a single unitarily molded part. As illustrated in FIG. 10, a static trimming machine cuts this part at three places to separate it into container body 12, thermic module body 14, and two moyles 16 and 18. As known in the art, a moyle is excess or scrap material that may be included in a molded part to facilitate molding and handling. The static trimming machine includes rollers (not shown) that bear against moyle 16 and rotate the part, as indicated by the arrow. The machine rotates the part against a hot knife blade 68 that can be extended for cutting and then retracted. Knife blade 68 separates or cuts moyle 16 from the remainder of the part. The same or a similar machine performs a similar cutting operation that separates moyle 18. The use of a static trimming machine is important to the manufacturing process because it leaves a smooth surface at the flange-like end of thermic module portion 14 to facilitate the welding step described below. While the blow-molding and cutting steps are believed to be important steps of the overall manufacturing process described herein, attention should be focused upon the step in which thermic module body 14 is attached to container body 12 by spin-welding, as illustrated in FIGS. 11A–C. Spin-welding is a method familiar to persons of skill in the art, by which the plastic of two parts fuses as a result of friction induced by spinning or rotating one part relative to the other. A suitable spin-welding machine is commercially available from TA Systems of Michigan. As illustrated in FIG. 11A, thermic module body 14 is inserted into the end of container body 12, and the resulting assembly is placed over a cylindrical tubular support (not shown) of the machine. As illustrated in FIG. 11B, the machine has a rotary head that lowers into contact with the flang-like surface of module body 14. The machine applies pressure that maintains module body 14 firmly in contact with container body 12. The head then begins rotating or spinning while maintaining that pressure. The rotating head spins module body 14 with respect to container body 12, which is kept stationary by the support on which it is mounted, as a result of the frictional engagement between the rotating head and the flange-like portion of module body 14. The friction between module body 14 and container body 12 fuses or welds them together. It is significant that pressure is applied before rotation begins and is maintained until the parts have fused because this sequence results in a more precise weld.

Note that the cutting step of the process exposes the cross-section of layers, such as the oxygen and flavor scalping barrier layer, in container body 12 and module body 14. While the layers are very thin and difficult to see with the unaided eye, they are sufficiently exposed that they are susceptible to degradation by atmospheric moisture and oxygen. Spin-welding is highly advantageous because, unlike other potential methods for attaching these parts to one another, spin-welding in the manner described above seals the exposed ends of container body 12 and module body 14, thereby inhibiting atmospheric moisture, oxygen or other contaminants from contacting and consequently degrading the oxygen barrier or other sensitive layers of container body 12. Also, the smooth and square surface left by the rotary cutter is more readily sealed by the spin-welding; spin-welding a jagged or uneven edge may not completely seal the sensitive interior layers.

Outer actuator assembly 42 may be spin-welded to the end of container body 12 as well. The ring of square recesses on its surface (see FIG. 2) facilitates engagement by a spin-welding head having a corresponding ring of square protuberances (not shown).

Figure 12:
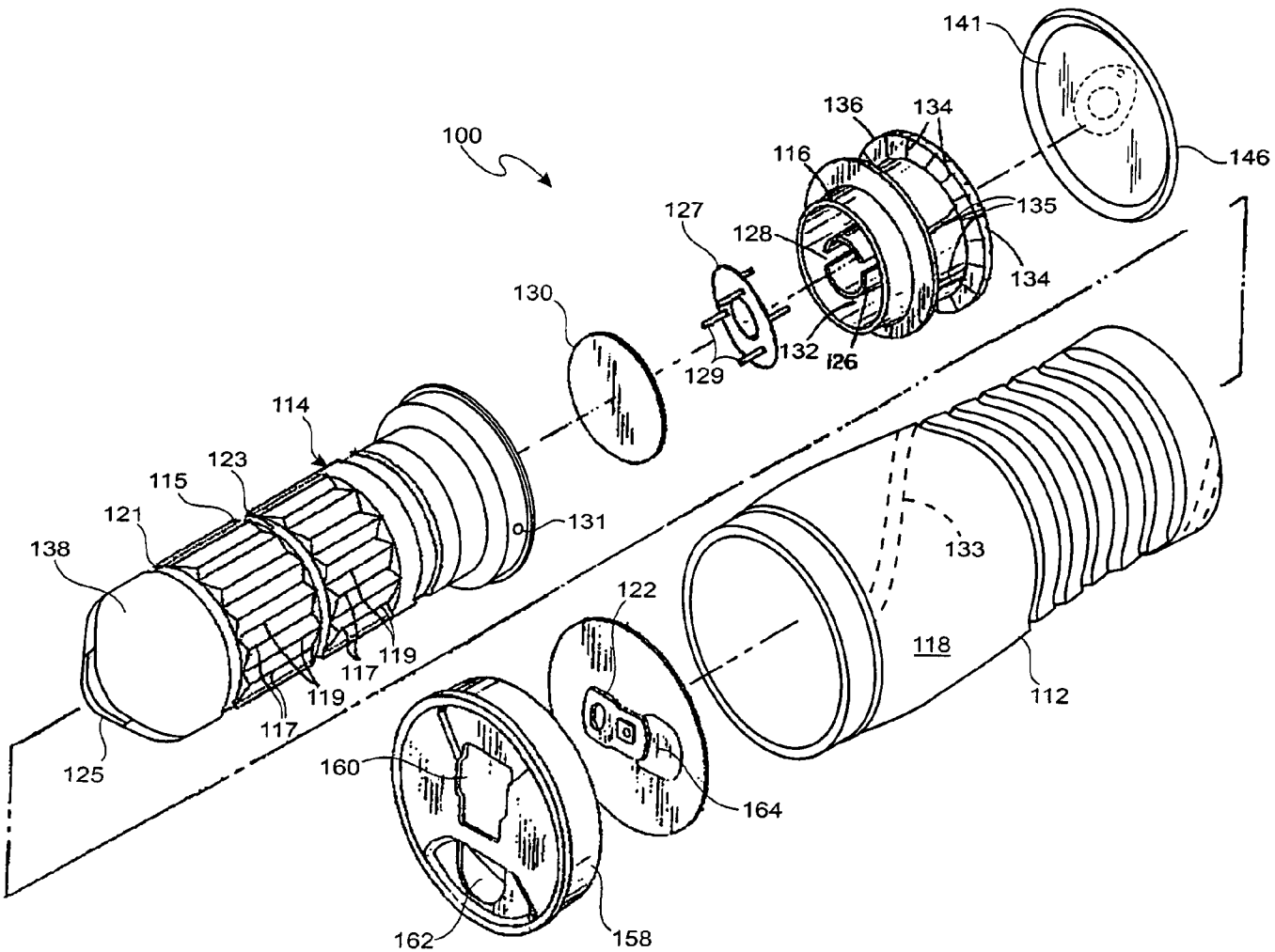
FIG. 12 is an exploded perspective view of the elements of another container in accordance with the present invention.

In another aspect of the present invention, FIG. 12 illustrates another container 100 in accordance with the present invention. Many of the features and elements of the container 100 are the same or substantially similar to the features and elements of the container 10 described above. The present invention contemplates that many of the features of the container 100 can be substituted for the features in the container 10, and vice versa. Accordingly, it should be understood that any one or more features of container 100 and container 10 can be substituted for analogous features in the other container within the scope of the present invention without describing in detail each and every combination herein.

Figure 13:
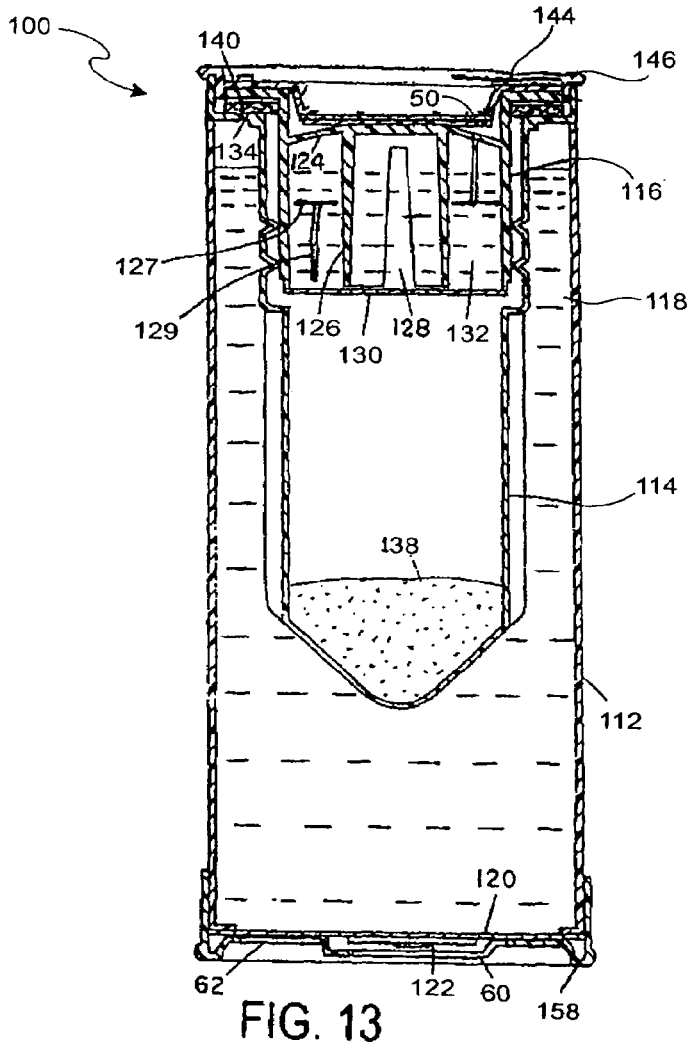
FIG. 13 is a sectional view of the container of FIG. 12.

Turning to FIGS. 12 and 13, the container 100 includes a container body 112, a thermic module body 114, and a thermic module cap 116. The module body 114 has an elongated heat-exchanger portion 115 that extends into container body 112. The interior of this portion defines a reaction chamber in which the reaction occurs that heats (or, in alternative embodiments of the invention, cools) the beverage or other contents 118. Typically, a first reactant 132 is contained in the thermic module cap 116. A second reactant 138 is contained the thermic module body 114. The two reactants are separated by a breakable reactant barrier 130. In general, one of the reactants is a liquid, such as water, and the other reactant is in a solid powdered or granular form, such as calcium oxide.

The heat-exchanger portion 115 of the module body 114 has a corrugated or pleated wall to increase surface area and, as a result, heat transfer. Although in the illustrated embodiment the wall is corrugated or pleated, in other embodiments the wall may have other suitable geometries. For a given material, the thinner the wall of the heat exchanger portion 115, the faster the heat transfer between the reactants 132 and 138 and the beverage 118. Hence, the wall is made very thin, preferably having a thickness between 0.004 inches and 0.012 inches. In another aspect of the pleated design of the heat exchanger portion 115, the peaks 117 and valleys 119 of the pleats have generous radii, preferably greater than 0.05 inches, more preferably greater than 0.06 inches. The large radii of the peaks 117 and valleys 119 prevents the thin walls from failing during the retort process. Further, two circular grooves 121 and 123 are provided. The grooves 121 and 123 facilitate folding at the grooves when the heat exchanger portion 115 is subjected to pressure as during the retort process. The folding helps prevent the thin walls of the heat exchanger portion 115 from creasing and cracking. The pointed end of the conical end of the heat exchanger portion has a thickened rib 125 extending therefrom. The rib 125 helps reduce deformation of the cone during the retort process.

The module cap 116 is press-fit in the open end of module body 114. Module cap 116 is of unitary construction and is made of a semi-rigid plastic, such as high density polyethylene. The breakable reactant barrier 130, preferably made of metal foil, is attached to the open end of module cap 116 to seal the water or other liquid reactant 132 inside. The reactant barrier 130 may be attached to the open end of module cap 116 by thermal bonding, ultrasonic bonding, use of an adhesive or any other suitable method. Module cap 116 has a disc-shaped or dome-shaped actuator button 124 and a cylindrical prong 126 with an elongated notch 128. An adapter puck 127 may also be provided to prevent the granular reactant 138 from falling into the bottom of module cap 116. Some reactants 138 may bum a hole through the bottom of the module cap 116. The adapter puck 127 includes an annular disc portion which fits inside the module cap 116 and a plurality of prongs 129 extending perpendicularly from both sides of the disc portion. The prongs 129 extending toward the barrier 130 improve the breakage of the barrier 130 when the thermic module is actuated to puncture the breakable reactant barrier 130.

Figure 14:
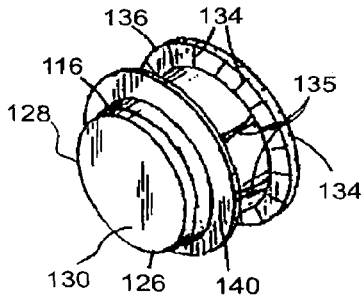
FIG. 14 is a perspective view of the reactant barrier attached to the module cap of the container of FIG. 12.
Figure 15:
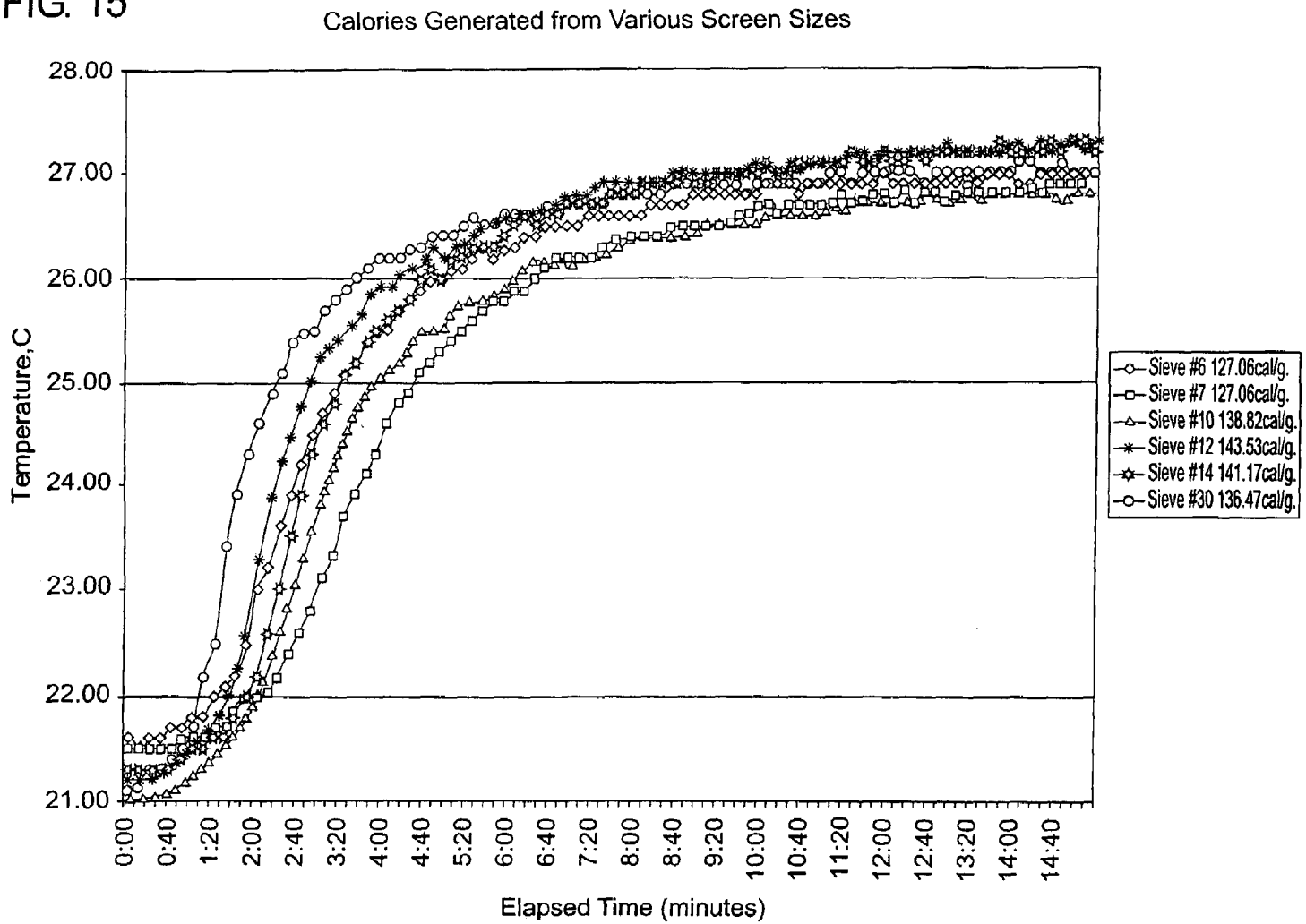
FIG. 15 is a graph of transient temperature curves for calcium oxide particles of various sieve sizes.
Figure 16:
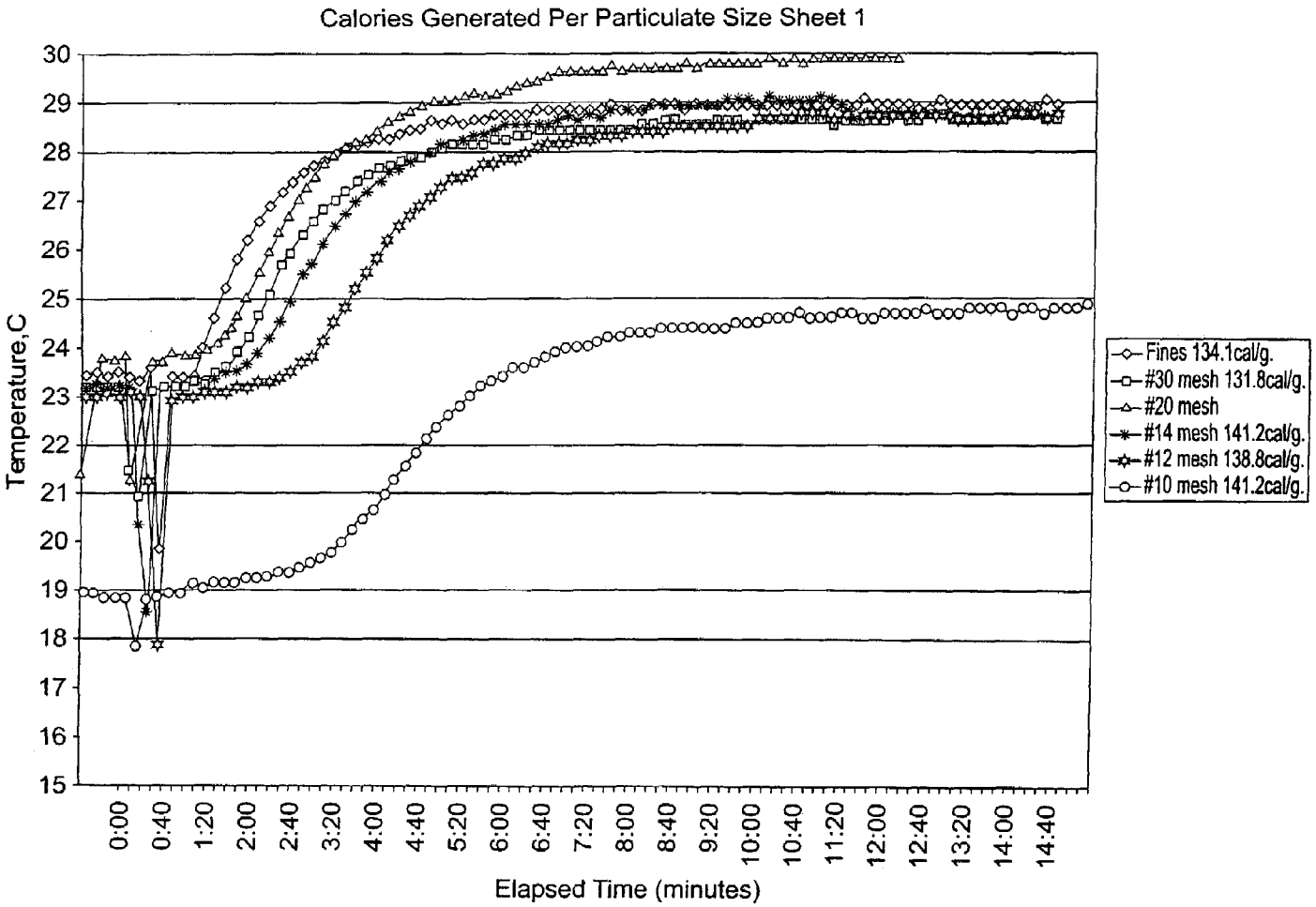
FIG. 16 is a graph of transient temperature curves for calcium oxide particles of various sieve sizes.
Figure 17:
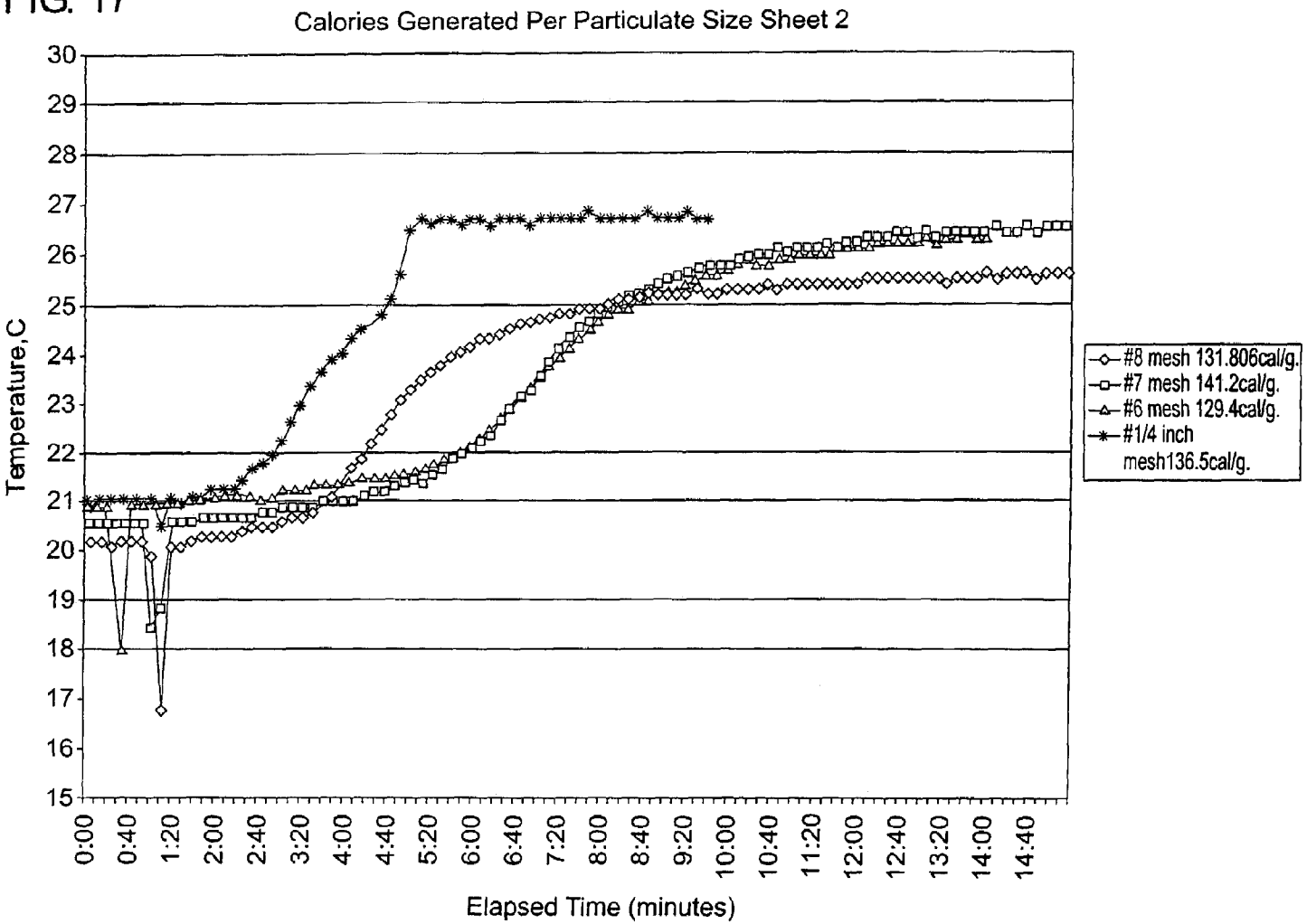
FIG. 17 is a graph of transient temperature curves for calcium oxide particles of various sieve sizes.
Figure 18:
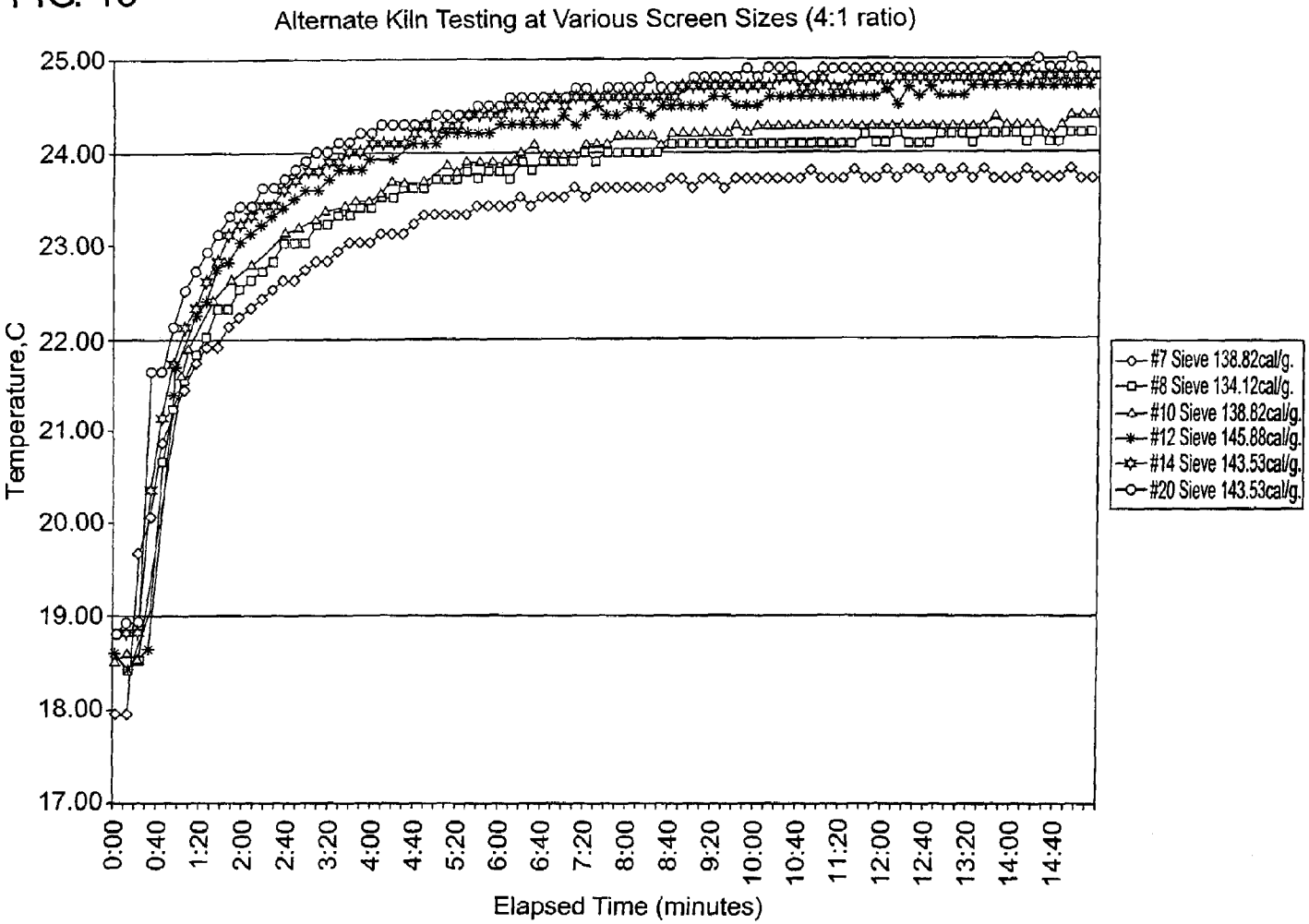
FIG. 18 is a graph of transient temperature curves for calcium oxide particles of various sieve sizes.

While the reactant barrier 130 may be attached to just the top annular surface of the open end of module cap 116, it is preferable that the reactant barrier 130 extend over the open end and down the side of the outer wall of the module cap 116 as shown in FIG. 14. Where the reactant barrier 130 is attached to the module cap 116 by thermal bonding, the thermal bonding process forms a radius on the outer edge of the top annular surface. The radiused edge further improves the bonding of the reactant barrier 130 to the module cap 116. When the container 100 is subjected to the retort process, pressure tends to push the barrier 130 upwards away from the top of the module cap 116. By sealing the barrier 130 to the side of the outer wall of the module cap 116 creates a much stronger adhesive seal by increasing the shear strength of the bond.

Module cap 116 has a plurality of ribs 134 protruding from the upper and lower surfaces of the flange portion 136 of module cap 116. The ribs 134 create channels between the flange portion 136 and the surrounding structure for venting pressure. The outer wall of the module cap is also provided with ribs 135 to create a vent channel between the outer surface of the module cap 116 and inner surface of the module body 14. When module cap 116 is fit in the open end of module body 114, the vent channels created by the ribs 134 and ribs 135 each of vent channels 34 provides a channel through which gas can escape during the reaction. The vent spaces extend longitudinally along the outside surface of the body portion of module cap 116, change direction to extend radially along the lower surface of the flange portion 136 of module cap 116, change direction again to extend longitudinally along the outside cylindrical surface of flange portion 136, and change direction again to extend radially along the upper surface of flange portion 136. This long, narrow, zig-zag path of channels inhibits escape of particles of the calcium oxide or other solid reactant 138 while allowing gas to vent.

A filter ring 140 is sandwiched between flange portion 136 and thermic module body 114. Filter ring 140 further prevents solid particles from escaping through the vent channels while allowing gases to vent. Filter ring 140 may be made of any suitable filter material such as synthetic sponge, open-cell foamed rubber, or any woven or fibrous materials such as paper and cloth. A suitable material is commercially available from Filter Material Corporation of Wisconsin under the product number AC20.

Instead of an outer actuator assembly 46 as in the container 10, the container 100 has a full panel pull-off 146 attached to the bottom end of the container body 112. The full panel pull-off 146 may be attached to the container body 112 by crimping, or any other suitable method. Alternatively, the full panel pull-off 146 may be attached to the bottom of the module cap 116. The full panel pull-off 146 is a removable lid of the type commonly used on canned foods and is like a typical pop-tab closure (e.g. the closure on a soft-drink aluminum can) except that the removable lid part covers substantially the entire opening of the container rather than just a small opening. The full panel pull-off 146 completely covers the opening at the bottom end of the container body 112. In this position, the pull-off 146 also covers the actuator button 124. The pull-off 146 preferably comprises a closure with a weakened region in a circular-shape along which the pull-off lid 141 breaks away from the remainder of the pull-off structure. The pull-off 146 is made of a material having sufficient strength, rigidity and thickness such that the actuator button 124 cannot be pushed without removing the pull-off 146, except in the case of extreme misuse or mishandling. For example, the pull-off may be made of aluminum or other material having similar strength and rigidity. The pull-off lid 141 is connected to a pull-ring 144 which is lifted and then pulled away from the pull-off lid 141 to remove the pull-off lid 141. Because the pull-off lid 141 breaks away from the rest of the pull-off 146 along the weakened region, it cannot be replaced once it is removed. Hence, the full-panel pull-off 146 provides an excellent tamper-evident seal while also making the container 100 less susceptible to vandalism while on store shelves. The pull-off 146 also functions as a pressure safety release valve. In the event that the reactant barrier 130 is pushed without removing the pull-off 146, pressure will build up inside the container because the vent channels in the thermic module cap 116 vent only to the interior of the pull-off 146. If the pressure reaches a certain level, the weakened region of the pull-off 146 will partially rupture thereby relieving the pressure.

A vent hole 131 may be provided in the sidewall of the bottom of the thermic module body 114. The vent hole 131 provides a vent path from the reaction chamber to the outside atmosphere. Similar to the safety pressure relief function of the pull-off 146 described above, the vent hole 131 releases pressure from the reaction chamber in the event that the thermic reaction is inadvertently actuated without removing the pull-off 146.

In addition to the vent hole 131, a coiled groove 133 may be molded into the outside wall of the container 112. The groove 133 starts at the location of the vent hole 131 and extends in a coil shape around and up the outside wall of the container 112. When a label (not shown) is adhesively mounted over the outside wall of the container, a conduit is formed by the label and the groove 133. Steam that exits the vent hole 131 will travel through the conduit formed by the groove 133 and the label along the cooler outer surface of the container 112 causing the steam to cool and condense.

The label (not shown) may be formed of a plasti-shield labeling material or other insulating material such as a thin sheet of styrofoam. This reduces the amount of heat that a person feels in their hands when they are consuming a hot food or beverage from the container 112. The label can be pre-printed prior to adhesive application to the outside wall of the container 112.

An endcap 120 with a pop-tab closure 122 of the type commonly used in beverage cans is crimped over the other top of container body 112 in the manner of a conventional beverage can. A lid 158 is mounted over endcap 120 and the end of container body 112. Lid 158 has two apertures 160 and 162. The lid 158 is mounted to the end of container body 112 with patches or spots of heat-sensitive adhesive (labeled "A") as shown in FIG. 8 for container 10) having an adhesion strength that decreases when heated to a specific threshold release temperature. Thus, the adhesive immobilizes lid 158 until container 100 is actuated and produces heat. This adhesive is the same adhesive as described above for container 10. As with container 10 described above, patches or spots of a suitable lubricant (labeled "L" in FIG. 8 for container 10) are interspersed with the adhesive patches so that when cap 158 is rotated the lubricant smears and prevents the adhesive from re-adhering cap 158 as it begins to cool and also allows the user to more easily rotate cap 158. Before a user actuates container 100, cap 158 is in the same position shown in FIG. 3 for the container 10. In this position aperture 160 is not aligned with pop-tab closure 122 and thus prevents a user from opening closure 122. Also, in this position aperture 162 is not aligned with the sealed opening 164 through which beverage 118 can be consumed.

An indicator (not shown) may be provided on the surface container 100 which shows when the beverage 118 has reached the desired temperature. For example, the indicator can be a label having a thermochromatic ink which changes color when it reaches a predetermined temperature. For example, the ink can be the Kromathermic Type 44 red available from Kromacorp International which turns from pink to white when heated to a predetermined temperature. When the indicator indicates that the beverage has reached a desired temperature, the user can then open the container 100 and consume the contents.

When container 100 heats and the adhesive reaches the release temperature, it loses sufficient adhesion strength that a user can rotate cap 158. The user rotates cap 158 until it is in the same position shown in FIG. 4 for container 10, as indicated by the arrow. In this position aperture 160 is aligned with pop-tab closure 122, thereby allowing the user to open it. Also, in this position aperture 162 is aligned with the sealed opening through which the user can consume the beverage. As in a conventional soft drink can, opening pop-tab closure 122 breaks the seal and allows a user to drink beverage 118 through the resulting opening. The user's lips contact the relatively cool plastic of cap 158 rather than the potentially very hot metal of endcap 120.

One of the reactants 132 or 138 may comprise specially designed calcium oxide particles. There are several characteristics of calcium oxide particles which will effect their reaction with the water. For example, varying the characteristics of the calcium oxide particles can affect such reaction attributes as volatility, rate of the reaction, and total amount of energy obtained from the reaction. Based on these characteristics, specific calcium oxide particles can be designed and produced to attain the desired overall reaction properties.

The porosity of the calcium oxide particles can greatly effect how volatile a particle will react when water is added. The processing of calcium oxide involves cooking it at 1000 degrees Fahrenheit which drives off moisture and gases that are naturally found in the material. This release creates pores in the material. The cooking time can be increased to a point where the pores will start to close back up in a process call a hard burn. By subjecting the particles to a proper amount of hard burn, the volatility of the reaction with water can be reduced to a more desirable level.

The size of the calcium oxide particles has an effect on how reactive that particle is. A group of small particles has more surface area that one large particle of equal weight. The greater the surface area, the faster and more thorough the particle will react when mixed with water. FIGS. 15–18 show transient temperature curves for particles of various sieve sizes ranging from a ¼ inch mesh (largest particle) through sieve #30 (smallest particle). In general, the curves show that smaller particles will heat up faster and also attain a higher maximum temperature. Accordingly, particles of various sizes may be chosen to produce the desired heating profile for the specific application for the container 100. For an application such as heating coffee or soup, a preferred distribution of particles sizes is:

| Particle Size (mesh) | Amount (%) |
|---|---|
| #7 | 2% maximum |
| #14 | 80% +/− 5% |

-continued

| Particle Size (mesh) | Amount (%) |
|---|---|
| #20 | 15% +/− 5% |
| Finer than #20 | 3% maximum |

Additives can also be added to the calcium oxide to increase or decrease the reaction rate. The additives work by several different methods, including chemically, mechanically, or physically altering the interface of the calcium oxide with the water.

Figure 19:
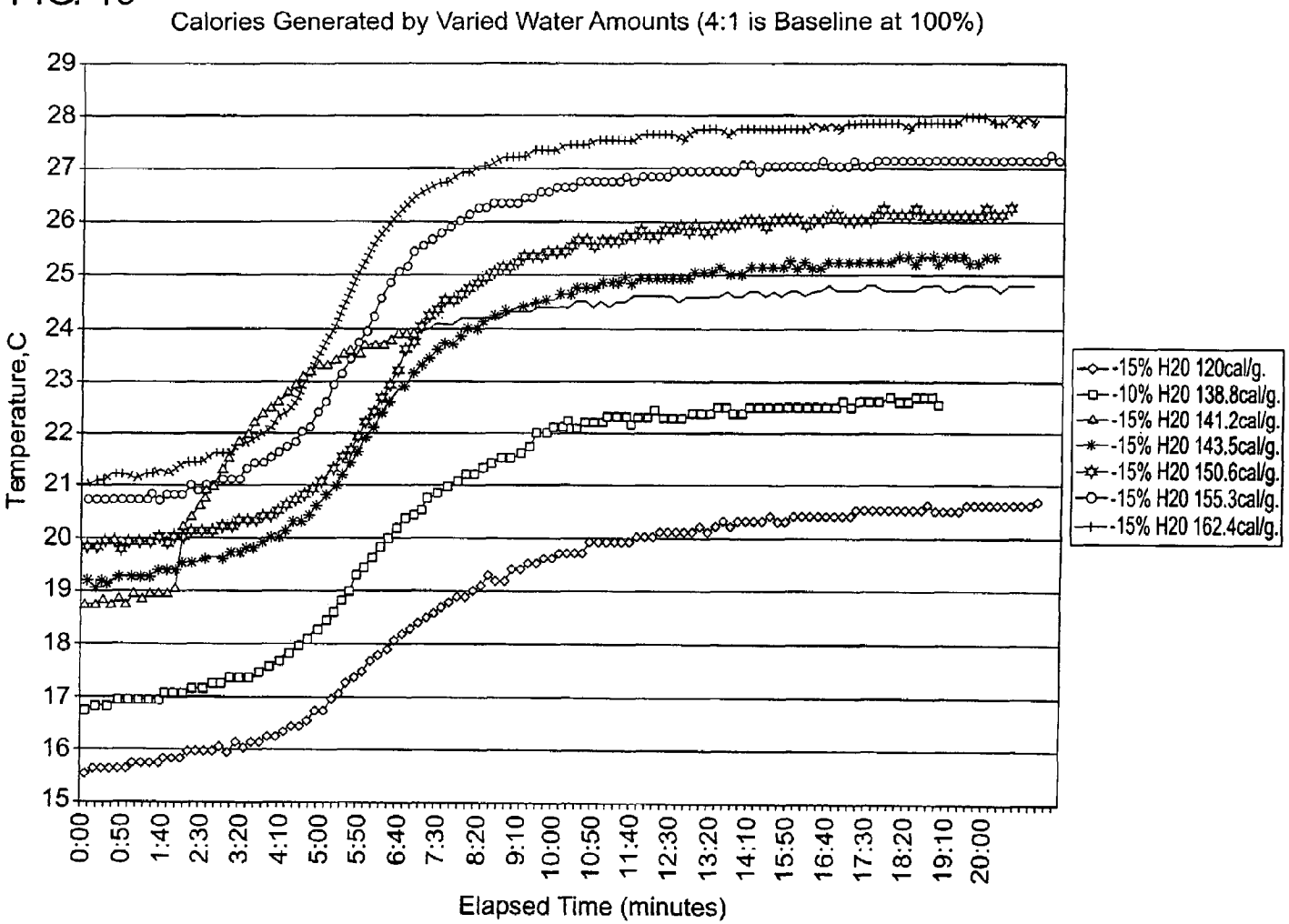
FIG. 19 is a graph of reaction/temperature curves for various ratios of water to calcium oxide.
Figure 20:
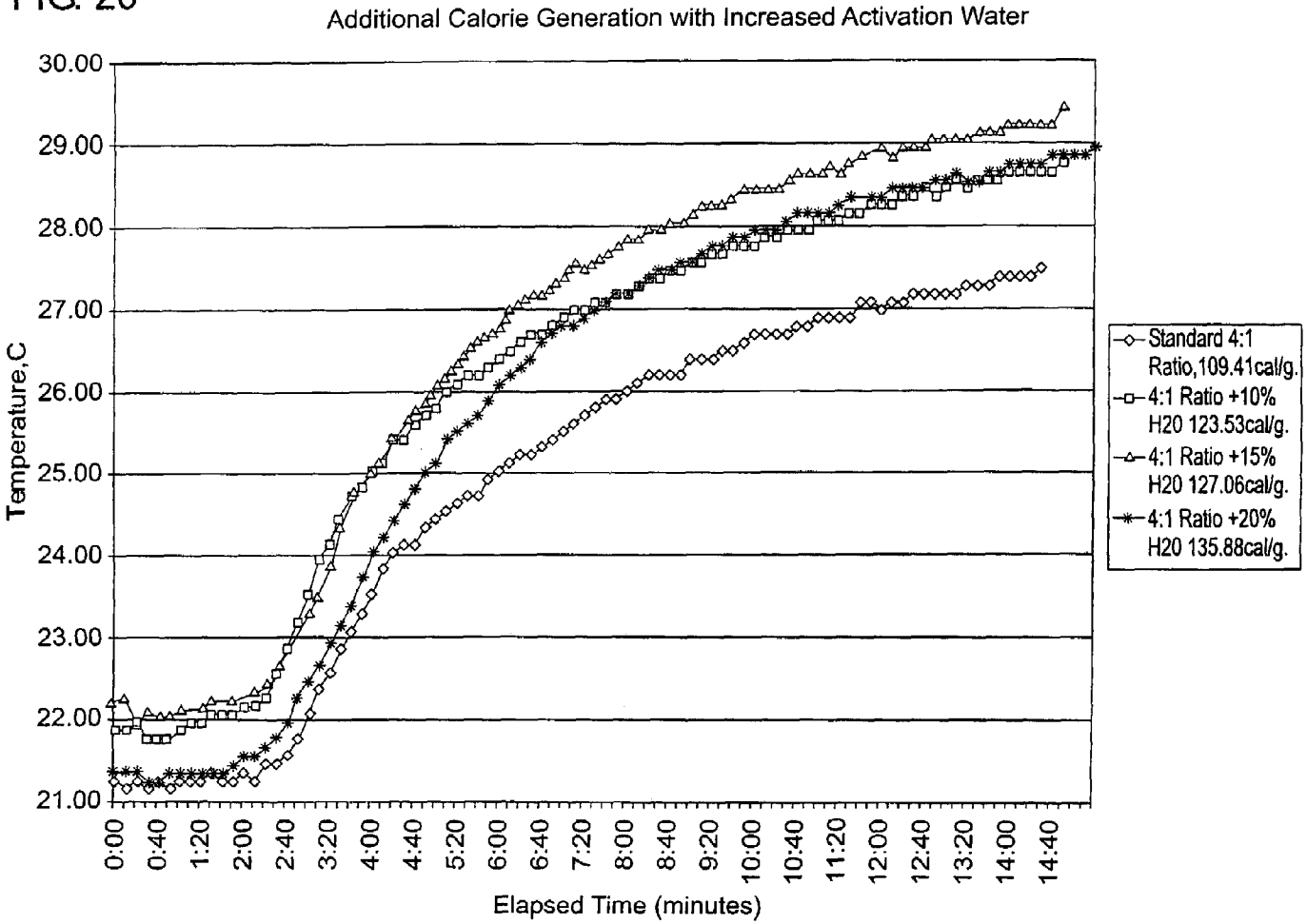
FIG. 20 is a graph of reaction/temperature curves for various ratios of water to calcium oxide.

One of the most important characteristics effecting the reaction is the reaction ratio, i.e. the ration of the calcium oxide to water. The standard ratio is 4 parts calcium oxide to one part water, by mass. Different reaction/temperature curves can be obtained by varying the ratio of calcium oxide to water. For example, it is possible to maximize the peak energy produced by any one size of particle or porosity of a particle. The ratio can also be altered to slightly increase or decrease the overall rate of the reaction. The graphs of FIGS. 19–20 show the reaction/temperature curves for various ratios of water to calcium oxide. It can be seen that increasing the amount of water to 1.15 parts per 4 parts calcium oxide by mass (i.e. +15% H2O in FIG. 20), the fastest reaction is obtained and also the most energy of the ratios tested.

The water comprising the other reactant 132 or 138 may also be modified to optimize its use in the present invention. For example, the water quality is a critical component. Any chlorine in the water may cause the breakable barrier 130 to corrode and fail. Minute deviations in water quality can adversely affect the thermal reaction with the calcium oxide. Trace mineral components in the water should not exceed the concentrations shown on the table in FIG. 21.

Additives may also be added to the water to modify the reaction and improve the compatibility of the water with the other materials of the container. A list of possible additives and their properties is included in the table of FIG. 22.

To actuate container 100, the user first removes the full panel pull-off 146 by lifting the pull-ring 144 and removing the pull-off lid 141. The user then depresses the actuator button 124 by exerting a force upon it in the general direction of the longitudinal axis of container 100. The force exerted upon the actuator button 124 causes it to snap or pop inwardly toward the reactant barrier 130.

In response to the inward flexure of actuator button 124, the distal end of prong 26 and the prongs 129 of the adapter puck 127 puncture the reactant barrier 30. The first reactant 132, generally a liquid reactant, flows through punctured reactant barrier 30 and mixes with the solid reactant 38 in the reaction chamber, i.e., the interior of the elongated portion of thermic module body 114. The notch 128 in prong 126 facilitates the flow of water 132 into the reaction chamber. The resulting exothermic reaction produces heat, which is transferred to beverage 118 by conduction through the pleated wall of the heat-exchanger portion of thermic module body 14. As noted above, in other embodiments of the invention, other reactants may be selected that give rise to an endothermic reaction when mixed.

Gas or steam produced in the reaction escapes the reaction chamber through vent channels created by the ribs 134, but any solid particles are filtered out by filter ring 140. Note that the inherent saturation of filter ring 140 by the escaping steam may enhance this filtration. The gas or steam that passes through filter ring 140 passes through the opening left by removal of the pull-off lid 141.

The user can then invert container 100 and wait until the reaction heats beverage 18, which typically occurs within about five minutes in a container 100 having a capacity of 10 fluid ounces (296 ml) of water or comparable beverage such as coffee or tea. As described above, when beverage 118 is heated to the temperature at which it is to be consumed, the adhesive has loosened sufficiently to allow the user to rotate cap 158. Patches or spots of a suitable lubricant (labeled "L" in FIG. 8) are interspersed with the adhesive patches so that when cap 158 is rotated the lubricant smears and prevents the adhesive from re-adhering cap 158 as it begins to cool and also allows the user to more easily rotate cap 158. The lubricant is preferably food-grade or approved for incidental food contact by the appropriate governmental authority, such as the Food and Drug Administration in the United States. The user then opens pop-tab closure 122 as described above and consumes beverage 118.

The method of manufacturing container 100 may include the same steps described above for container 10, except where the structure of the containers 100 and 10 differ.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A container for selectably changing the temperature of its contents by mixing a first reactant with a second reactant, comprising:

a container body having a material chamber for containing said contents;

a thermic module connected to one end of said container body and extending at least partially into said container body, an opposite end of said container body having a container opening into said material chamber, said thermic module comprising an actuator, a piercing member movable between a retracted position and an extended position in response to a force placed on a portion of said actuator, a breakable barrier, and first and second chambers for containing said reactants separated from one another by said breakable barrier, wherein a distal end of said piercing member breaks said breakable barrier when said elongated member is in said extended position to allow mixing of said reactants;

a full panel pull-off mounted to one of said thermnic module or to said one end of said container, said full panel pull-off completely covering said actuator, said full panel pull-off having a removable pull-off lid, said full panel pull-off having sufficient strength and rigidity to prevent actuation of said actuator until said pull-off lid is first removed, said pull-off lid being configured to be removable by breaking the material connecting it to the remainder of the full panel pull-off; and a lid mounted to said opposite end of said container body.

2. The container of claim 1 wherein one of said chambers is a beat exchanger portion which extends proximally into the container body, said heat exchanger portion having a pleated wall and at least one circumferential groove on the edge of said pleated wall.

3. A container for selectably changing the temperature of its contents by mixing a first reactant with a second reactant, comprising:

a container body having a material chamber for containing said contents;

a thermic module connected to one end of said container body and extending at least partially into said container body, an opposite end of said container body having a container opening into said material chamber, said thermic module comprising an actuator, a piercing member movable between a retracted position and an extended position in response to a force placed on a portion of said actuator, a breakable barrier, and first and second chambers for containing said reactants separated from one another by said breakable barrier, wherein a distal end of said piercing member breaks said breakable barrier when said elongated member is in said extended position to allow mixing of said reactants;

at least one of said first and second chambers being a heat exchanger portion which extends proximally into the container body, said heat exchanger portion having a pleated wall having a plurality of folds around a circumference of said heat exchanger portion, said folds having radii of at least 0.05 inches, and said heat exchanger portion having at least one circumferential groove on the edge of said pleated wall, a full panel pull-off mounted to one of said thermic module or to said one end of said container, said full panel pull-off completely covering said actuator, said full panel pull-off having a removable pull-off lid, said full panel pull-off having sufficient strength and rigidity to prevent actuation of said actuator until said pull-off lid is first removed; and a lid mounted to said opposite end of said container body.

4. A container for selectably changing the temperature of its contents by mixing a first reactant with a second reactant, comprising:

a container body having a material chamber for containing said contents;

a thermic module connected to one end of said container body and extending at least partially into said container body, an opposite end of said container body having a container opening into said material chamber, said thermic module comprising an actuator, a piercing member movable between a retracted position and an extended position in response to a force placed on a portion of said actuator, a breakable barrier, and first and second chambers for containing said reactants separated from one another by said breakable barrier, wherein a distal end of said piercing member breaks said breakable barrier when said elongated member is in said extended position to allow mixing of said reactants;

said first chamber being a heat exchanger portion which extends into said container body;

a full panel pull-off mounted to one of said thermic module or to said one end of said container, said full panel pull-off completely covering said actuator, said full panel pull-off having a removable pull-off lid, said full panel pull-off having sufficient strength and rigidity to prevent actuation of said actuator until said pull-off lid is first removed;

said container having a vent hole which completes a fluid path from said heat exchanger portion to the ambient atmosphere surrounding the exterior of said container while said full panel pull-off is installed; and a lid mounted to said opposite end of said container body.

5. The container of claim 4 wherein said thermic module comprises a thermic module cap disposed distal to said heat exchanger portion and wherein said fluid path extends from said heat exchanger portion between a wall of said container and a wall of said thermic module cap to said vent hole.

6. The container of claim 1 wherein said first chamber comprises a heat exchanger portion which extends proximally into said container body and a thermic module cap disposed distal to said heat exchanger portion, said thermic module cap comprising said second chamber, said breakable barrier and said piercing member.

7. The container of claim 6 wherein said breakable barrier comprises a sheet of material which is attached to said thermic module cap to enclose said second chamber.

8. The container of claim 6 wherein said breakable barrier is attached to a top surface of said thermic module cap and also to the outside walls extending from said top surface.

9. A container for selectably changing the temperature of its contents by mixing a first reactant with a second reactant, comprising:

a container body having a material chamber for containing said contents, said container body having an internal side wall and an external side wall and said external side wall has a groove extending from at or near the bottom of said container body up the side of said external side wall in a helical shape;

a thermic module connected to one end of said container body and extending at least partially into said container body, an opposite end of said container body having a container opening into said material chamber, said thermic module comprising an actuator, a piercing member movable between a retracted position and an extended position in response to a force placed on a portion of said actuator, a breakable barrier, and first and second chambers for containing said reactants separated from one another by said breakable barrier, wherein a distal end of said piercing member breaks said breakable barrier when said elongated member is in said extended position to allow mixing of said reactants;

a full panel pull-off mounted to one of said thermic module or to said one end of said container, said full panel pull-off completely covering said actuator, said full panel pull-off having a removable pull-off lid, said full panel pull-off having sufficient strength and rigidity to prevent actuation of said actuator until said pull-off lid is first removed; and a lid mounted to said opposite end of said container body.

10. A container for selectably changing the temperature of its contents by mixing a first reactant with a second reactant, comprising:

a container body having a material chamber for containing said contents and a container opening for removing said contents from said container body;

a thermic module thermally coupled to said container body, an opposite end of said container body having a container opening into said material chamber, said thermic module comprising an actuator, and first and second chambers for containing said reactants separated from one another until the actuator is actuated, wherein said first reactant comprises calcium oxide particles in which at least 75% of said particles filter through a #7 mesh and are captured by a #14 mesh.

11. The container of claim 10 wherein said calcium oxide particles comprise a mixture of calcium oxide particles of differing sizes in which at least 75% of said particles filter through a #7 mesh and are captured by a #14 mesh.

12. A container for selectably changing the temperature of its contents by mixing water and calcium oxide particles, comprising:

a container body having a material chamber for containing said contents and a container opening for removing said contents from said container body;

a thermic module thermally coupled to said container body, an opposite end of said container body having a container opening into said material chamber, said thermic module comprising an actuator, and first and second chambers for containing said reactants separated from one another until the actuator is actuated;

wherein the ratio of water to calcium oxide by mass is about 1.15 parts water to 4 parts calcium oxide and said first reactant comprises calcium oxide particles in which at least 75% of said particles filter through a #7 mesh and are captured by a #14 mesh.

13. The container of claim 12 wherein said calcium oxide particles comprise a mixture of calcium oxide particles of differing sizes in which at least 75% of said particles filter through a #7 mesh and are captured by a #14 mesh.

14. A method of selectably changing the temperature of the contents of a container comprising the steps of:

providing said container thermally coupled with a thermic module having first and second reactants;

removing a pull-off lid of a full panel pull-off mounted to said container, said pull-off lid being configured to be removable by breaking the material connecting it to the remainder of the full panel pull-off, said full panel pull-off having sufficient strength and rigidity to prevent actuation of an actuator until said pull-off lid is first removed;

actuating said actuator to cause the mixing of said first and second reactants.

15. The method of claim 14 wherein said first reactant comprises water and said second reactant comprises calcium oxide particles.

16. The method of claim 15 wherein said first reactant comprises calcium oxide particles in which at least 75% of said particles filter through a #7 mesh and are captured by a #14 mesh.

17. The method of claim 15 wherein said calcium oxide particles comprise a mixture of calcium oxide particles of differing sizes in which at least 75% of said particles filter through a #7 mesh and are captured by a #14 mesh.

18. The method of claim 15 wherein the ratio of water to calcium oxide by mass is about 1.15 parts water to 4 parts calcium oxide.

19. A container for selectably changing the temperature of its contents by mixing a first reactant with a second reactant, comprising:

a container body having a material chamber for containing said contents;

a thermic module connected to one end of said container body and extending at least partially into said container body, an opposite end of said container body having a container opening into said material chamber, said thermic module comprising an actuator, a piercing member movable between a retracted position and an extended position in response to a force placed on a portion of said actuator, a breakable barrier, and first and second chambers for cantaining said reactants separated from one another by said breakable barrier, said breakable barrier comprising a sheet of material which is attached to said thermic module can to enclose said second chamber, said breakable barrier being attached to said thermic module cap by one of thermal bonding, ultrasonic bonding or use of an adhesive, wherein a distal end of said piercing member breaks said breakable barrier when said elongated member is in said extended position to allow mixing of said reactants;

said first chamber comprising a heat exchanger portion which extends proximally into said container body and a thermic module cap disposed distal to said heat exchanger portion, said thermic module cap comprising said second chamber, said breakable barrier and said piercing member;

a full panel pull-off mounted to one of said thermic module or to said one end of said container, said full panel pull-off completely covering said actuator, said full panel pull-off having a removable pull-off lid, said full panel pull-off having sufficient strength and rigidity to prevent actuation of said actuator until said pull-off lid is first removed; and a lid mounted to said opposite end of said container body.

20. The container of claim 7 wherein said breakable barrier is attached to said thermic module cap by thermal bonding and the thermal bonding process creates a radiused edge on a top surface of said thermic module cap.

21. The container of claim 1 further comprising a visual indicator which indicates that the indicator has reached a predetermined temperature.

22. The container of claim 21 wherein said visual indicator comprises a spot of thermochromatic ink on the surface of said container.

* * * * *